US005357724A

United States Patent [19]

Sonoda

[11] Patent Number: 5,357,724

[45] Date of Patent: Oct. 25, 1994

[54] STAIR TREAD

[75] Inventor: Munekatsu Sonoda, Kawaguchi, Japan

[73] Assignee: Sonoda Factory Co., Ltd., Tokyo, Japan

[21] Appl. No.: 77,397

[22] Filed: Jun. 17, 1993

[30] Foreign Application Priority Data

Dec. 21, 1992 [JP] Japan ..... 4-091802[U]

[51] Int. Cl.[5] ..... E04F 11/00

[52] U.S. Cl. ..... 52/182; 52/188; 52/191; 52/177

[58] Field of Search ..... 52/182 OR, 184, 188, 52/190, 191, 177, 179

[56] References Cited

U.S. PATENT DOCUMENTS 893,198 8/1908 Schachner ..... 52/190

1,457,515 6/1923 Frisch ..... 52/190

4,451,063 5/1984 Snyder ..... 52/188

FOREIGN PATENT DOCUMENTS 2-149035 12/1990 Japan .

*Primary Examiner*—Carl D. Friedman

*Assistant Examiner*—Wynn E. Wood

*Attorney, Agent, or Firm*—Oblon, Spivak, McClelland, Maier & Neustadt

[57] ABSTRACT

A stair tread, in which synthetic rubber is used to encase metal side core portions arranged at the side edges of a substantially horizontal core section at a downward right-angle thereto. A lip is provided along the side edges of the tread surface. The lip projects upward, the outside surface of the lip is flush with the surface of the synthetic rubber that covers the side core sections, and the lip is formed in one piece, of synthetic rubber.

3 Claims, 3 Drawing Sheets

STAIR TREAD

BACKGROUND OF THE INVENTION

1. Field of the Invention

The present invention relates to a stair tread mainly for use in outside stairways of low-rise residential buildings and the like, or emergency stairways in residential and other buildings.

2. Description of the Prior Art

Conventional outside stairs and emergency stairs in buildings used for residential and other purposes usually consist of shaped steel tread plates attached to steel section stringers, with the tread plates being in the form of a shallow pan which is filled with cement. In JP-A Hei 2-149035 the present inventor proposed a stair tread in which noise is reduced by encasing the metal end plate portions of the tread with synthetic rubber.

However, in this prior tread in which only the surface is covered with the synthetic rubber, rainwater collects on the upper surface of the tread and seeps into the spaces between the tread and the stringers. This ages the painted surfaces, eventually corrodes the stringer itself, produces unsightly streaks of rust and can lead to a dangerous situation by degrading the strength of the stringers.

One solution is to pack and seal the space between tread and stringer, but sealant materials have a degrading effect on the appearance, and rainwater collects on the upper portion of packing materials. In addition, the use of sealant and packing means a corresponding increase in the amount of work and time required to assemble the structure.

OBJECT AND SUMMARY OF THE INVENTION

An object of this invention is to provide a tread that is easy to manufacture and can prevent the entry of rainwater in the spaces between tread and stringers without detracting from the appearance.

To attain the above object, the stair tread according to the present invention comprises a core member of metal including a substantially horizontal core section and side core sections extending downwards from the edges at each end of the horizontal core section, a synthetic rubber covering over the surface of the core members, an upwardly projecting lip formed where the synthetic rubber covers the side edges of the horizontal core section, with the outside surface of the lip being flush with the surface of the synthetic rubber that covers the side core sections, wherein the synthetic rubber that covers the right and left edges and the lip are formed in one piece.

When the tread having the above structure is affixed to the stringers by the insertion of bolts into fixing holes in the side face, the synthetic rubber that covers the side core sections resiliently deforms. This resilient deformation causes the outer side face of the lips at the edges of the tread surface to be forced into close contact with the side surface of the stringers, closing up the top part of the gap between tread and stringer. As a result, rainwater on the inner side of the stringer is prevented from seeping into the space between tread and stringer and instead flows down the lip towards the tread surface area.

Further features of the invention, its nature and various advantages will be more apparent from the accompanying drawings and following detailed description of the invention.

DESCRIPTION OF THE PREFERRED EMBODIMENT

Figure 1:
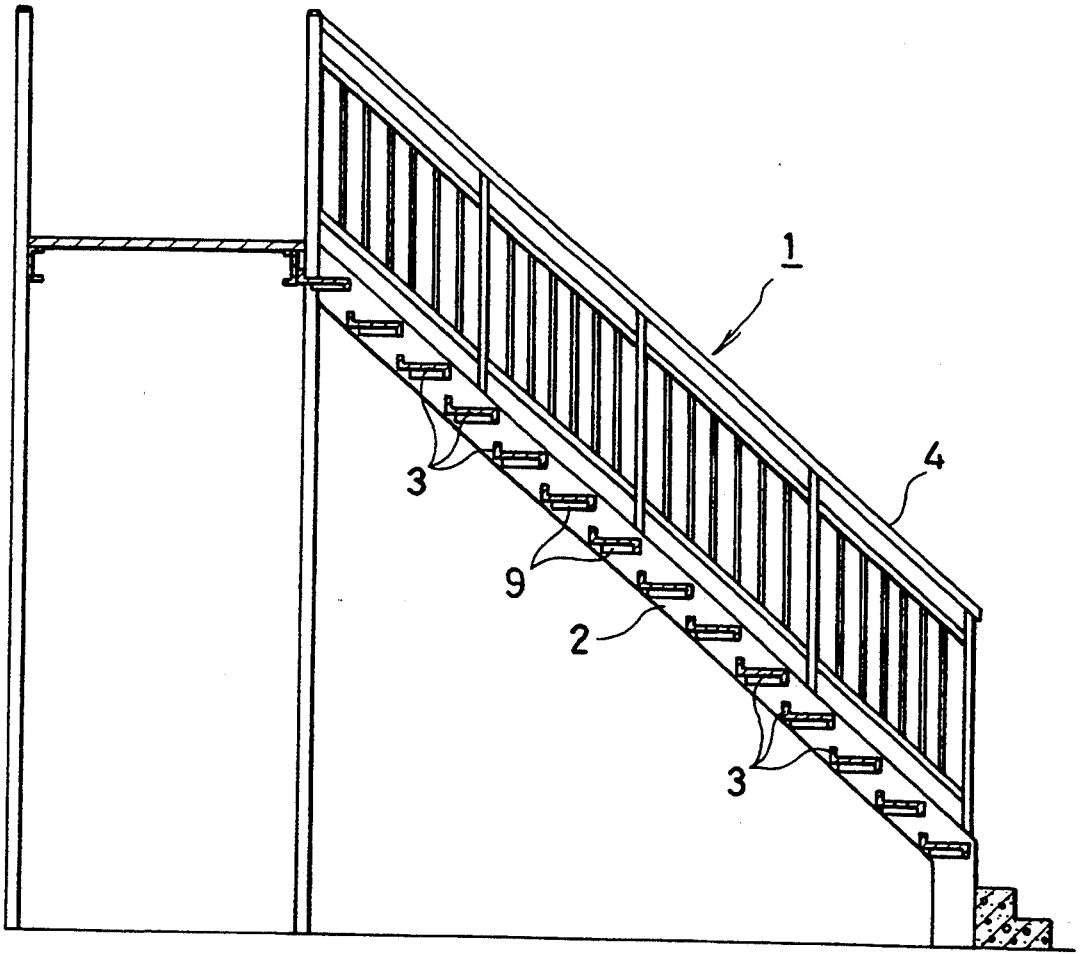
FIG. 1 is a cross-sectional view of a staircase to which the tread of this invention can be applied.
Figure 2:
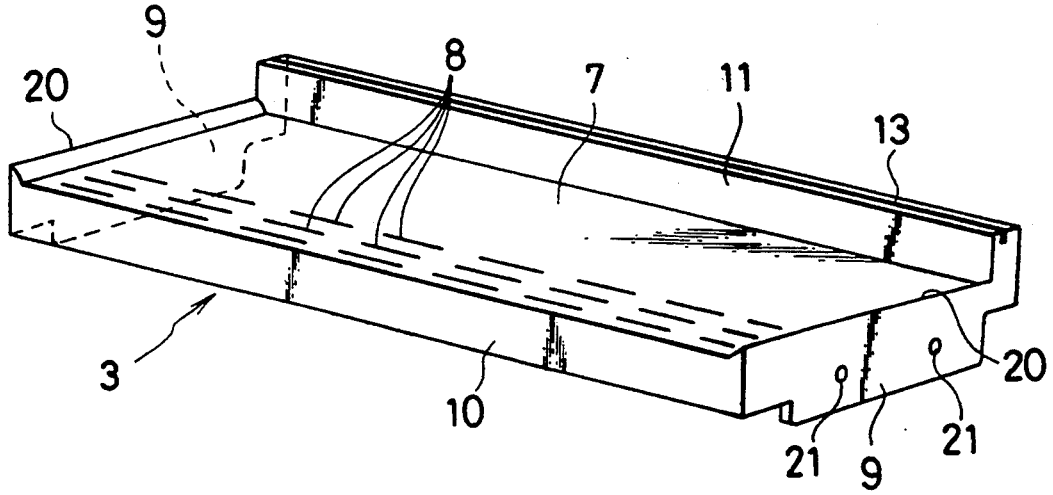
FIG. 2 is a perspective view of an embodiment of the tread according to the invention.

FIG. 1 is a cross-sectional view of a staircase to which the tread of this invention can be applied, and a typical example of outside stairs used by residential buildings and the like. The staircase 1 consists of treads 3 affixed at prescribed intervals between a pair of inclined stringers 2 spaced a prescribed distance apart. A handrail 4 is arranged above stringer 2.

The tread 3 consists of a metal core section 5 such as a metal pan or the like, which is covered polyurethane rubber or other such synthetic rubber 6. The tread surface 7, the part that people step on, is a horizontally extended, substantially level rectangle having anti-slip serrations 8 formed on its upper surface. At each end of the tread surface 7 is a mounting surface 9. A front face 10 is formed at the front edge of the tread surface 7 and a rear face 11 at the rear edge. The upper edge of the rear face 11 has a groove 13 to accept the lower edge of a riser board 12, while the top edge of the riser 12 slots into a groove 14 formed in the lower edge of the front face 10.

Figure 3:
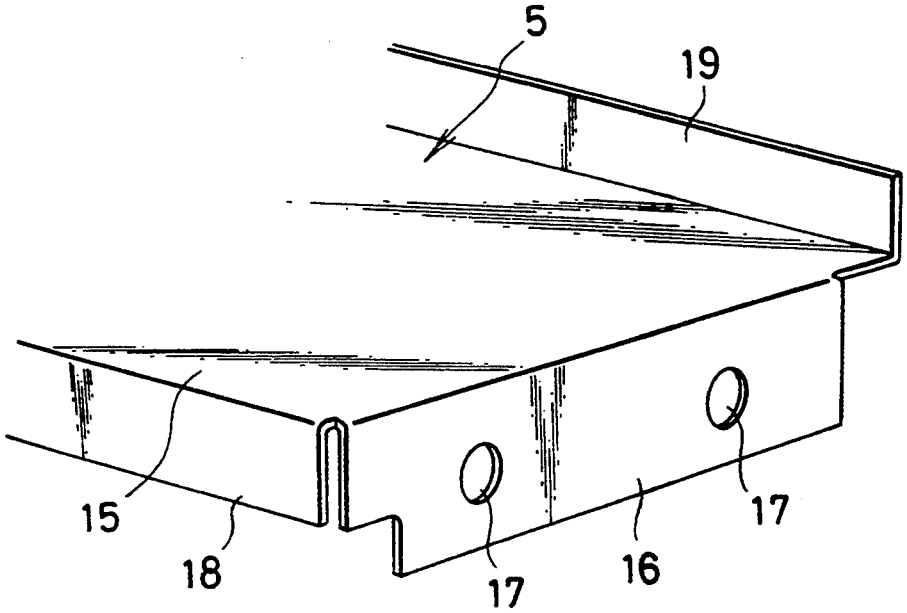
FIG. 3 is a perspective view of part of the core structure of the tread shown in FIG. 2.
Figure 4:
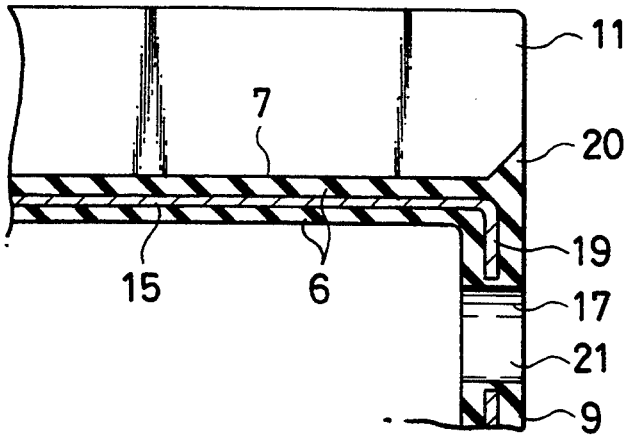
FIG. 4 is an enlarged cross-sectional view of the same tread.

The core section 5 shown in FIG. 3 is formed of steel plate bent to shape. A horizontal core section 15 is a horizontally extended, substantially level rectangle in shape. Formed at each end of the horizontal core section 15 is a side core section 16 bent downward substantially at right-angles to the horizontal core section 15, and each side core section 16 is provided with through-holes 17. The front edge of the horizontal core section 15 is bent down substantially at right-angles to form a front edge section 18, and the rear edge of the horizontal core section 15 is bent up substantially at right-angles to form a rear edge section 19. Ordinary steel plate can be used to form the core section 5, but using damping steel plate enables noise to be further reduced. As the synthetic rubber 6 used to cover the core section 5, there may be used polyurethane rubber or other synthetic rubber that has good wear-resistance and weather-resistance.

In the tread 3 according to this invention, an upward-protruding lip 20 that has a substantially right-angled triangular cross-section and is integrally formed of synthetic rubber is provided along the entire upper side edges of the synthetic rubber 6, which is to say the side edges of the tread surface 7, so that the outer surface of the lip is flush with the mounting surface 9. The mounting surface 9 has fixing holes 21 to communicate with the through-holes 17 in the core section 5.

The tread can be fabricated by adhering synthetic rubber sheet to the front and back surfaces of the horizontal core section 15, side core sections, front edge sections and rear edge sections. Triangular synthetic-rubber strip can be used to form the lip along the edges by bonding the strip with the hypotenuse facing inward. With the lip strip thus arranged can be bonded by placing it in a suitably shaped mold, heating it to its plastic deformation temperature and then applying pressure.

Figure 5:
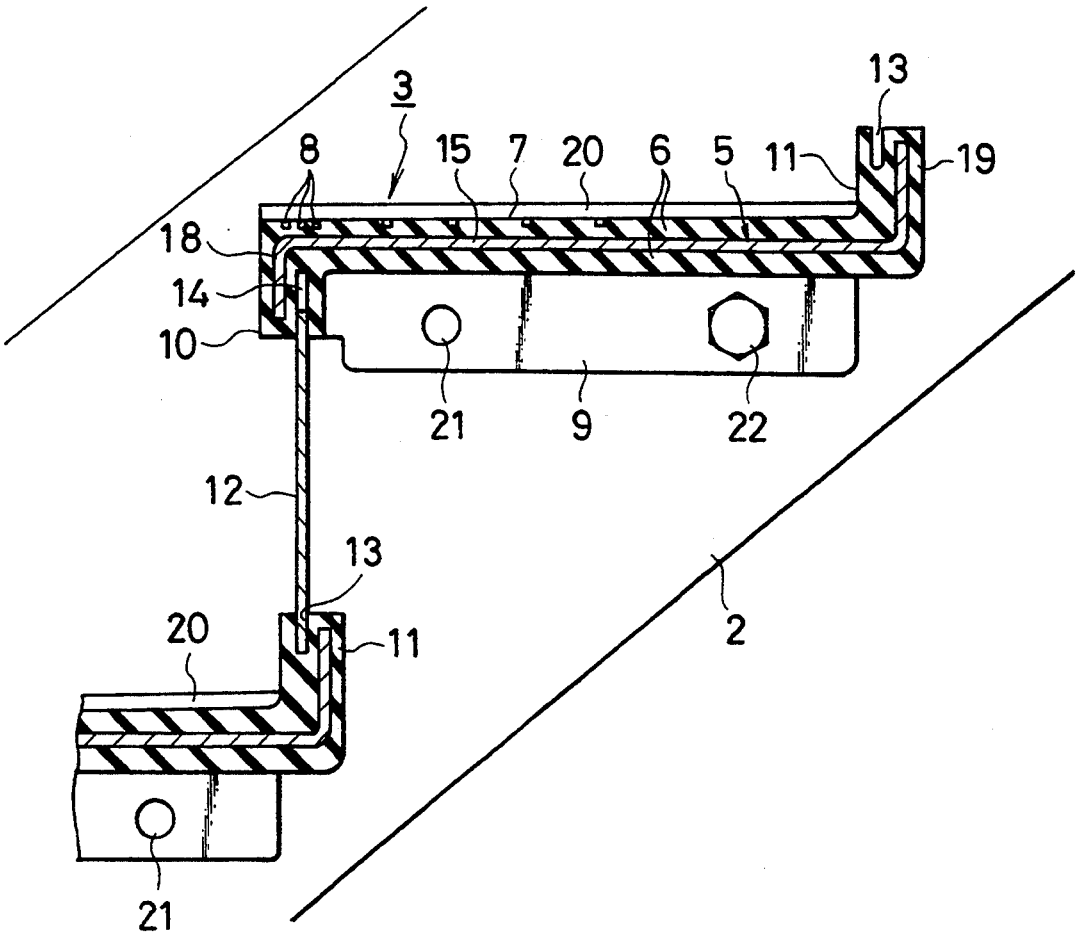
FIG. 5 is a side cross-sectional view of the tread of this invention attached to a stringer.

To attach the tread 3 to the stringers 2, fixing holes (not shown) are formed at a prescribed spacing in the side face of the stringers 2, the mounting surface 9 of the tread 3 is positioned against the stringer 2 so that the fixing holes 21 are lined up with the fixing holes of the stringer 2, and a bolt 22 is then passed through the holes and a nut is tightened on the bolt 22 to bolt the tread 3 and stringer 2 together. This also compresses the synthetic rubber 6, thereby bringing the lip 20 in close resilient contact with the side face of the stringers 2. As a result, the top part of the space between the stringer 2 and the tread 3 closes up, preventing the entry of rainwater. As shown in FIG. 5, when the treads 3 are thus fitted one by one between the stringers 2, the riser groove 13 formed in the upper edge of the rear face 11 of the tread 3 of one step is positioned opposite the riser groove 14 formed in the lower edge of the front face 10 of the tread 3 of the next step up. The space between treads 3 can therefore be closed by first inserting the top edge of a riser 12 well into the groove 14 of the next tread 3 up, then bringing the lower edge of the riser 12 far enough down into the groove 13 of the lower tread 3. It is preferable to form the risers 12 of aluminum or acrylic sheet or other such material that does not readily corrode.

By fixing the treads 3 between the stringers 2 in this way, the impact of feet on the tread surface 7 of each tread 3 is reduced by the cushioning effect of the synthetic rubber that overlays the tread surface 7. The result is that the stairs have a pleasant, more comfortable feel and less direct noise is generated by the treads 3, compared with conventional stairs. Also, the synthetic rubber 6 on the mounting surface 9 and the lip 20 can absorb dimensional variations in the treads 3 and fitting error. Moreover, the resilient force of the lip 20 keeps it tightly against the stringer 2, so no gap opens up and rainwater on the tread surface 7 is prevented from running onto the pressure contact faces of the tread and stringers.

With reference to FIG. 5, the handling of rain on the tread 3 can be further enhanced by adjusting the thickness of the synthetic rubber 6 on the horizontal core section 15. Specifically, the thickness of the synthetic rubber 6 can be gradually decreased to slope it towards the front face 10, so water flows off the front. Another way of achieving front face 10 same result is by horizontal adjustment of the fixing holes of the stringers and the treads to thereby tilt each tread 3 slightly forward to ensure that water drains off the tread surface 7, which would simplify the fabrication process.

The tread 3 can be made by bonding sheet synthetic rubber of the same thickness over the whole surface of the core section 5, placing the assembly in a mold, heating it to the plastic deformation temperature of the rubber sheet and then applying pressure to mold the rubber into one piece, and by using a mold with an inclined surface to form the rubber covering on the horizontal core section 15 so that it slopes towards the front edge to allow water to drain off from the tread surface 7. First forming an appropriately shaped groove in the inclined mold surface would enable the lip 20 to be integrally formed during the same operation. This would mean less wasted rubber, and would eliminate the need to separately obtain and apply rubber to form the lip 20.

While the invention has been described with reference to the embodiment shown in the drawings, it is to be understood that the invention is not limited thereto but may be appropriately implemented to the extent that there is no alteration to the arrangement encompassed by the claim.

What is claimed is:

1. A stair tread, comprising:

a core member of metal including a substantially horizontal core section and side core sections extending downward from end edges of the horizontal core section;

a covering of synthetic rubber over the core member surfaces;

an upwardly projecting lip formed where the synthetic rubber covers the side core sections of the horizontal core section, with the outside surface of the lip being flush with the surface of the synthetic rubber that covers the side core sections; wherein the synthetic rubber that covers the end edges and the lip are integrally in a one-piece formation.

2. A stair tread according to claim 1 wherein the synthetic rubber covering on the horizontal core section is sloped by being gradually decreased in thickness from a rear edge to a front edge of said stair tread.

3. A stair tread according to claim 1 wherein the lip is angled and the lip has a substantially right-angled triangular cross-section.

* * * * *